US007953231B2

(12) United States Patent
Ishida

(10) Patent No.: US 7,953,231 B2
(45) Date of Patent: May 31, 2011

(54) AUDIO OUTPUT APPARATUS AND AUDIO PROCESSING SYSTEM

(75) Inventor: Tomomi Ishida, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/683,936

(22) Filed: Jan. 7, 2010

(65) Prior Publication Data

US 2010/0310087 A1 Dec. 9, 2010

(30) Foreign Application Priority Data

Jun. 9, 2009 (JP) ..... 2009-138390

(51) Int. Cl.
*H04R 1/10* (2006.01)
*H04R 29/00* (2006.01)

(52) U.S. Cl. ..... 381/74; 381/58; 455/575.2; 439/669

(58) Field of Classification Search ..... 381/58, 381/74, 124, 309, 111–115; 700/94; 455/6.3, 455/41.1–41.3, 569.1, 575.1, 575.2; 439/577, 439/669

See application file for complete search history.

(56) References Cited

U.S. PATENT DOCUMENTS

| | | | | |
|---|---|---|---|---|
| 5,642,424 | A * | 6/1997 | Masaki | 381/309 |
| 6,397,087 | B1 * | 5/2002 | Kim et al. | 455/569.1 |
| 6,594,366 | B1 * | 7/2003 | Adams | 381/74 |
| 7,349,546 | B2 * | 3/2008 | Ganton | 381/58 |
| 7,450,726 | B2 * | 11/2008 | Goyal | 381/74 |
| 7,519,185 | B2 * | 4/2009 | Liang | 381/74 |
| 7,749,024 | B2 * | 7/2010 | Chambers et al. | 439/604 |
| 2007/0142942 | A1 * | 6/2007 | Hyatt | 700/94 |
| 2007/0237170 | A1 * | 10/2007 | Proctor et al. | 370/462 |
| 2008/0085010 | A1 * | 4/2008 | Suzuki | 381/74 |
| 2009/0252344 | A1 * | 10/2009 | Mao et al. | 381/74 |
| 2010/0020982 | A1 * | 1/2010 | Brown et al. | 381/74 |
| 2010/0142720 | A1 * | 6/2010 | Kon | 381/74 |

FOREIGN PATENT DOCUMENTS

| | | | |
|---|---|---|---|
| JP | 6-4957 | | 1/1994 |
| JP | 8-251684 | | 9/1996 |
| JP | 2001-24753 | A | 1/2001 |
| JP | 2003-37886 | | 2/2003 |
| JP | 2004-153350 | | 5/2004 |
| JP | 2006-279959 | A | 10/2006 |
| JP | 2007-121694 | | 5/2007 |
| JP | 2008-90618 | | 4/2008 |
| JP | 2008-289033 | A | 11/2008 |
| JP | 2008-289101 | | 11/2008 |
| JP | 2009-10798 | A | 1/2009 |

OTHER PUBLICATIONS

Japanese Office Action dated Mar. 16, 2010, Japanese Patent Application No. 2009-138390.

Japanese Office Action dated Jul. 6, 2010, Japanese Patent Application No. 2009-138390.

* cited by examiner

*Primary Examiner* — Xu Mei

(74) *Attorney, Agent, or Firm* — Patterson & Sheridan, LLP

(57) ABSTRACT

According to one embodiment, an audio output apparatus, includes: a receiver configured to receiver audio information from an audio processor; an output module configured to output the received audio information; a cable configured to connect between the output module and the receiver to communicate the audio information; a tension detector configured to detect whether tension of greater than or equal to a threshold value is applied to the cable; a determination module configured to determine, when the tension detector detects tension of greater than or equal to the threshold value, a control command to be executed by the audio processor; and a transmitter configured to transmit the determined control command to the audio processor.

6 Claims, 10 Drawing Sheets

FIG.4

| PLACEMENT | TENSION DETECTED | CURRENT SITUATION | CONTENT TO BE EXECUTED |
|---|---|---|---|
| BOTH EARPHONES NOT IN PLACE | 0 | - | PAUSE COMMAND |
| BOTH EARPHONES NOT IN PLACE | 1 | - | RECORDING AUDIO DATA, PAUSE COMMAND |
| ONE OF EARPHONES NOT IN PLACE | 0 | - | AUDIO SYNTHESIS COMMAND, VOLUME DECREASE COMMAND |
| ONE OF EARPHONES NOT IN PLACE | 1 | - | AUDIO SYNTHESIS COMMAND |
| AT LEAST ONE OF EARPHONES BACK IN PLACE FOR PREDETERMINED TIME | - | TENSION IS "0" AND IT IS DETECTED THAT BOTH EARPHONES ARE NOT IN PLACE | POWER OFF COMMAND |
| AT LEAST ONE OF EARPHONES IN PLACE → AT LEAST ONE OF EARPHONES BACK IN PLACE | - | TENSION IS "0" AND IT IS DETECTED THAT BOTH EARPHONES ARE NOT IN PLACE | PLAY COMMAND |
| AT LEAST ONE OF EARPHONES IN PLACE → AT LEAST ONE OF EARPHONES BACK IN PLACE | - | TENSION IS "1" AND IT IS DETECTED THAT BOTH EARPHONES ARE NOT IN PLACE | OUTPUTTING RECORDED AUDIO DATA, PLAY COMMAND |
| AT LEAST ONE OF EARPHONES IN PLACE → AT LEAST ONE OF EARPHONES BACK IN PLACE | - | TENSION IS "0" AND IT IS DETECTED THAT ONLY ONE EARPHONE IS NOT IN PLACE | STEREO OUTPUT COMMAND, VOLUME INCREASE COMMAND |
| AT LEAST ONE OF EARPHONES IN PLACE → AT LEAST ONE OF EARPHONES BACK IN PLACE | - | TENSION IS "0" AND IT IS DETECTED THAT ONLY ONE EARPHONE IS NOT IN PLACE | STEREO OUTPUT COMMAND |

FIG.5

SETUP SCREEN FOR PROCESS OF WHEN EARPHONE IS DISPLACED

WHEN BOTH EARPHONES ARE ACCIDENTALLY DISPLACED:

PAUSE, THEN REWIND FOR LITTLE AND PLAY AFTER EARPHONES ARE BACK IN PLACE ▼

WHEN BOTH EARPHONES ARE INTENTIONALLY DISPLACED:

PAUSE, THEN PLAY AFTER EARPHONES ARE BACK IN PLACE ▼

WHEN ONE EARPHONE IS ACCIDENTALLY DISPLACED:

OUTPUT AUDIO DATA IN MONAURAL FROM ONE EARPHONE ▼

WHEN BOTH EARPHONES ARE INTENTIONALLY DISPLACED:

DECREASE VOLUME, THEN OUTPUT AUDIO DATA IN MONAURAL FROM ONE EARPHONE ▼

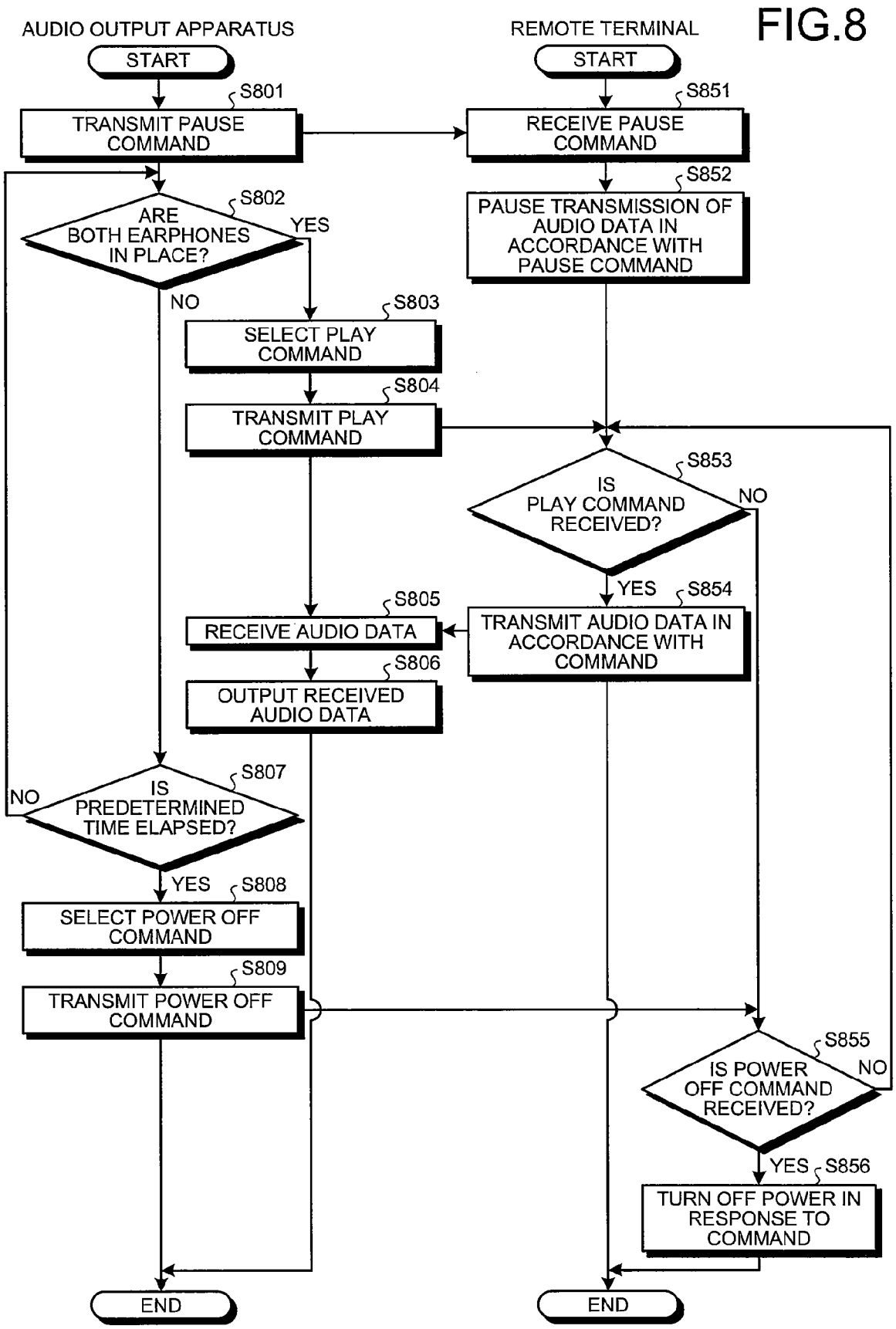
FIG.8
AUDIO OUTPUT APPARATUS
REMOTE TERMINAL
START
START
S801
TRANSMIT PAUSE COMMAND
S851
RECEIVE PAUSE COMMAND
S852
PAUSE TRANSMISSION OF AUDIO DATA IN ACCORDANCE WITH PAUSE COMMAND
S802
ARE BOTH EARPHONES IN PLACE?
YES
NO
S803
SELECT PLAY COMMAND
S804
TRANSMIT PLAY COMMAND
S853
IS PLAY COMMAND RECEIVED?
NO
YES
S854
TRANSMIT AUDIO DATA IN ACCORDANCE WITH COMMAND
S805
RECEIVE AUDIO DATA
S806
OUTPUT RECEIVED AUDIO DATA
S807
IS PREDETERMINED TIME ELAPSED?
NO
YES
S808
SELECT POWER OFF COMMAND
S809
TRANSMIT POWER OFF COMMAND
S855
IS POWER OFF COMMAND RECEIVED?
NO
YES
S856
TURN OFF POWER IN RESPONSE TO COMMAND
END
END

AUDIO OUTPUT APPARATUS AND AUDIO PROCESSING SYSTEM

CROSS-REFERENCE TO RELATED APPLICATIONS

This application is based upon and claims the benefit of priority from Japanese Patent Application No. 2009-138390, filed on Jun. 9, 2009, the entire contents of which are incorporated herein by reference.

BACKGROUND

1. Field

One embodiment of the invention relates to an audio output apparatus for outputting audio data, and an audio processing system.

2. Description of the Related Art

Recently, earphones that are placed in user's ears and output audio are tend to be used in various situations as the earphones becoming widely used.

The earphones that are in place in the ears are displaced under various situations. For example, the earphones are intentionally removed by the user, or the earphones are accidentally displaced when, for example, the earphone cable is caught by obstacles. Hence, it is preferred to control audio data in accordance with various situations.

For example, Japanese Patent Application Publication (KOKAI) No. 2009-10798 discloses a conventional technology for controlling output of audio information in accordance with whether the earphones are in place or not. With this, it is prevented that the user fails to listen to the audio information.

However, the conventional technology controls the output of audio information by only determining whether the earphones are in place or not, and it does not take into account situations under which the earphones are placed.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

FIG. 4 is an exemplary command management table in the embodiment;

FIG. 5 is an exemplary explanatory view of a screen for receiving a request to be executed when at least one of earphones is displaced in the embodiment;

FIG. 8 is an exemplary flowchart of process performed after the determination module selects, when both of the earphones are intentionally removed by a user, the pause command in the embodiment;

DETAILED DESCRIPTION

Various embodiments according to the invention will be described hereinafter with reference to the accompanying drawings. In general, according to one embodiment of the invention, an audio output apparatus, comprises: a receiver configured to receiver audio information from an audio processor; a plurality of output modules configured to output the received audio information; a cable configured to connect between the output module and the receiver to communicate the audio information; a tension detector configured to detect a tension applied to the cable; a placement detector configured to detect whether the output module is in place with respect to a user; and a transmitter configured to transmit a first control command to the audio processor when the placement detector detects that the output modules are not in place and the tension detector detects a tension of greater than or equal to a predetermined threshold value, and configured to a second control command different from the first control command to the audio processor when the placement detector detects that the output modules are not in place and the tension detector does not detect the tension of greater than or equal to the threshold value.

According to another embodiment of the invention, an audio processing system, comprises: an audio output apparatus configured to output audio information; and an audio processor configured to provide the audio information to the audio output apparatus. The audio output apparatus comprises: a first receiver configured to receiver audio information from the audio processor; a plurality of output modules configured to output the audio information; a cable configured to connect between the output module and the receiver to communicate the audio information; a tension detector configured to detect a tension applied to the cable; a placement detector configured to detect whether the output module is in place with respect to a user; and a first transmitter configured to transmit a first control command to the audio processor when the placement detector detects that the output modules are not in place and the tension detector detects a tension of greater than or equal to a predetermined threshold value, and configured to a second control command different from the first control command to the audio processor when the placement detector detects that the output modules are not in place and the tension detector does not detect the tension of greater than or equal to the threshold value. The audio processor comprises: a second transmitter configured to transmit the audio information to the audio output apparatus; a second receiver configured to receive the control command from the audio output apparatus; and a controller configured to control the audio information in accordance with the control command received by the receiver.

Figure 1:
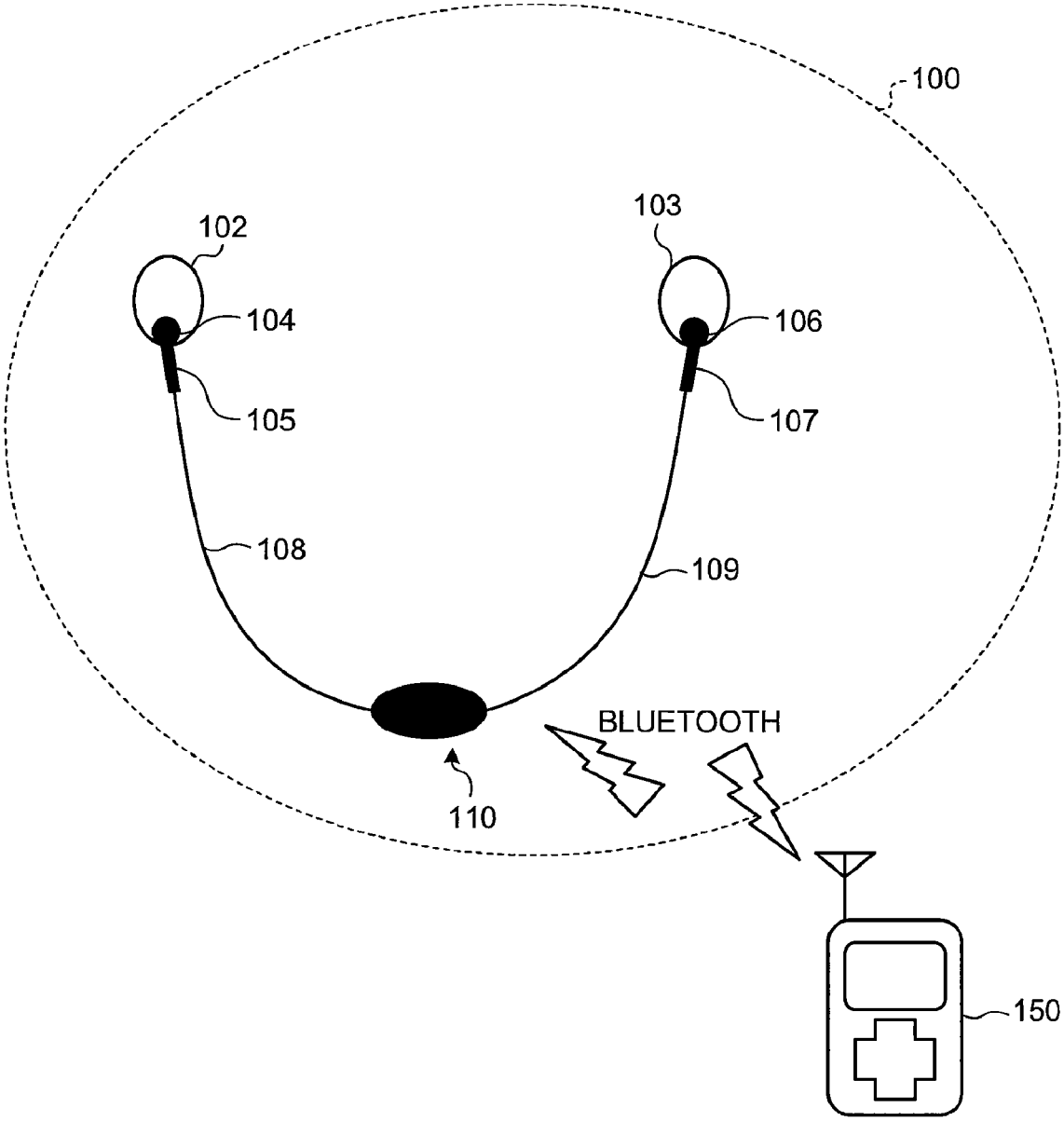
FIG. 1 is an exemplary explanatory exterior view of an audio output apparatus and a remote terminal according to an embodiment of the invention.

FIG. 1 is an explanatory view illustrating exterior of an audio output apparatus 100 and a remote terminal 150 according to one embodiment of the invention. The audio output apparatus 100 illustrated in FIG. 1 has a container 110, an earphone 102, and an earphone 103 connected to the earphone 102 via a cable. The container 110 processes audio data.

The remote terminal 150 is a device such as an audio visual (AV) device that reproduces audio data and output the reproduced audio data to the audio output apparatus 100. The remote terminal 150 may be any device as long as audio can be reproduced. For example, the remote terminal 150 can be a portable audio reproduction device, or can be a video reproduction device providing video along with the audio.

In the first embodiment, the audio output apparatus 100 and the remote terminal 150 are connected to each other by using Bluetooth (Registered Trademark), which is one of standards for near field wireless communication. Accordingly, the audio output apparatus 100 and the remote terminal 150 can transmit and receive audio data, control command for controlling the audio data, and the like, with respect to each other. Instead of using Bluetooth (Registered Trademark) for the wireless communication, other types of wireless communication such as infrared wireless communication may be used to connect the audio output apparatus 100 and the remote terminal 150 to each other.

The audio output apparatus 100 has the left earphone 102 that is to be placed in the left ear and the right earphone 103 that is to be placed in the right ear. The left earphone 102 and the right earphone 103 each outputs audio data. In other words, the left earphone 102 is a left sound output module, and the right earphone 103 is a right sound output module.

The audio output apparatus 100 further has a left cable 108 that connects between the container 110 and the left earphone 102 and a right cable 109 that connects between the container 110 and the right earphone 103. The left cable 108 and the right cable 109 are passages communicating audio data from the container 110 to the left earphone 102 and the right earphone 103, respectively.

A left-ear-placement detection sensor 104 for detecting placement of the left earphone 102 and a left-side-tension sensor 105 are provided on a left earphone 102 side. A right-ear-placement detection sensor 106 for detecting placement of the right earphone 103 and a right-side-tension sensor 107 are provided on a right earphone 103 side.

The left-ear-placement detection sensor 104 and the right-ear-placement detection sensor 106 detects whether the earphones 102, 103 (sound output modules) are placed in the ears, respectively. Acceleration sensors capable of detecting orientation of the earphones 102, 103 based on gravitational direction and/or capable of detecting whether the earphones 102, 103 are displaced from the ears can be used as the left-ear-placement detection sensor 104 and the right-ear-placement detection sensor 106. Moreover, the left-ear-placement detection sensor 104 and the right-ear-placement detection sensor 106 can be any sensors as long as they can detect whether the earphones are placed or displaced with respect to the ears. Hence, a temperature detection sensor that detects a temperature of a user may also be used. In addition, other sensors such as an infrared sensor, a pressure sensor, an optical sensor, a sound pressure sensor, and a perspiration detection sensor, that can detect the placement of the earphones may be used.

The left-side-tension sensor 105 detects loads on a connecting portion between the left earphone 102 and the left cable 108 as tension. The right-side-tension sensor 107 detects loads on a connecting portion between the right earphone 103 and the right cable 109 as tension. Accordingly, when the earphones 102, 103 are displaced, results of the detection of the left-side-tension sensor 105 and the right-side-tension sensor 107 can be used to determine whether the earphones 102, 103 are displaced intentionally or accidentally.

More particularly, the tension detected by the left-side-tension sensor 105 and the right-side-tension sensor 107 are each compared with a predetermined threshold value to determine whether the earphones 102, 103 are displaced intentionally or accidentally. When the detected tension is smaller than the threshold value, it is assumed that the user removed one of the corresponding earphones 102, 103 by hand, or in other words, the user intentionally removed the at least one of the earphones 102, 103. On the other hand, when the detected tension is larger than the threshold value, it is assumed that the at least one of the earphones 102, 103 are accidentally displaced.

In the embodiment, it is determined whether at least one of the earphones 102, 103 is intentionally removed by the user or accidentally displaced, by associating earphone placement and tension of each cable (whether tension greater than or equal to the threshold value is applied to the cables). That is to say, it is assumed that at least one of the earphones 102, 103 is intentionally removed when the tension of the cable corresponding to the at least one of the earphones 102, 103 is less than the threshold value so that it is detected that the at least one of the earphones 102, 103 is not in place. On the other hand, it is assumed that at least one of the earphones 102, 103 is accidentally displaced when the tension of the cable of the at least one of the earphones 102, 103 is greater than or equal to the threshold value so that it is detected that the at least one of the earphones 102, 103 is not in place (for example, when the cable is caught by obstacles).

When at least one of the earphones 102, 103 is intentionally or accidentally displaced, the audio output apparatus 100 transmits a command for controlling the audio data to the remote terminal 150. The audio data can be controlled by using audio/video remote control profile (AVRCP) of Bluetooth (Registered Trademark).

Figure 2:
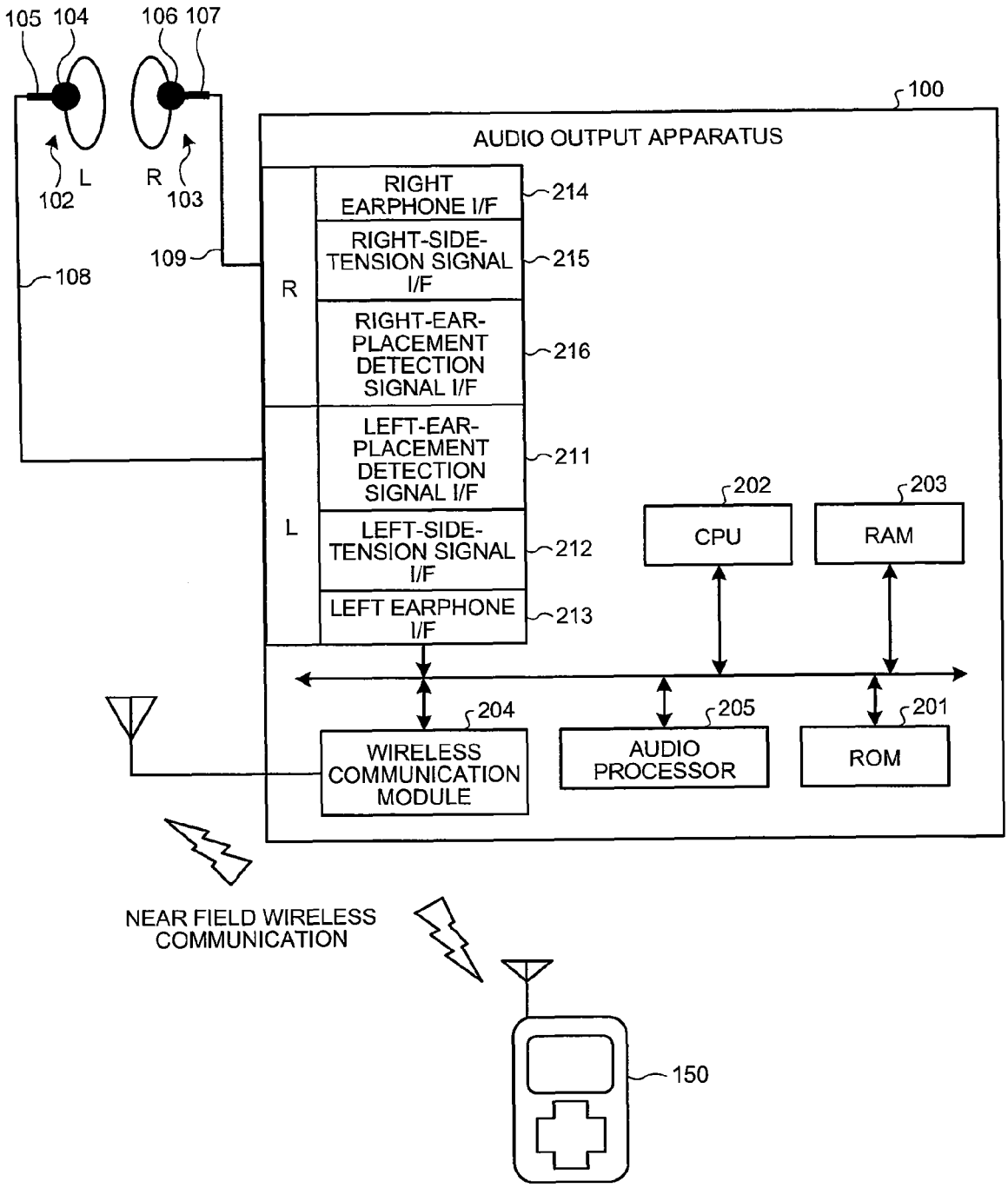
FIG. 2 is an exemplary block diagram of a hardware configuration of the audio output apparatus in the embodiment.

FIG. 2 is an explanatory view illustrating a hardware configuration of the audio output apparatus 100. As illustrated in FIG. 2, the container 110 of the audio output apparatus 100 has a read only memory (ROM) 201, a central processing unit (CPU) 202, a random access memory (RAM) 203, a wireless communication module 204, an audio processor 205, a left-ear-placement detection signal interface (I/F) 211, a left-side-tension signal I/F 212, a left earphone I/F 213, a right earphone I/F 214, a right-side-tension signal I/F 215, and a right-ear-placement detection signal I/F 216.

The left earphone I/F 213 and the right earphone I/F 214 shares a common ground point, while each having distinct terminal pin.

The left-ear-placement detection signal I/F 211 receives an acceleration signal from the left-ear-placement detection sensor 104. The right-ear-placement detection signal I/F 216 receives an acceleration signal from the right-ear-placement detection sensor 106.

The left-side-tension signal I/F 212 receives a tension signal from the left-side-tension sensor 105. The right-side-tension signal I/F 215 receives a tension signal from the right-side-tension sensor 107.

The ROM 201 stores therein an audio control program executed by the CPU 202.

The RAM 203 preliminarily stores therein various threshold values to be compared with signals received from various sensors. Further, the RAM 203 stores a table for determining control commands to be executed in accordance with current situations. Furthermore, the RAM 203 records therein audio data under circumstances such as when the user is unable to listen to the audio by accident.

The wireless communication module 204 encodes data, and performs wireless communication in accordance with a connection type. For example, when the audio data is received by using the Bluetooth (Registered Trademark), the wireless communication module 204 uses advanced audio distribution profile (A2DP) used to receive music data.

Further, the wireless communication module 204 transmits a command for controlling the audio data by the CPU 202 to the remote terminal 150 by using the AVRCP, to control the audio data. Regarding the Bluetooth (Registered Trademark), the signals received from the various sensors can be transmitted to the remote terminal 150 using human interface device (HID) profile so as to process, determine, and control data on the remote terminal 150 side.

The CPU 202 reads out the program stored in the ROM 201, and fully controls the audio output apparatus 100.

For example, the CPU 202 monitors the earphones 102, 103 connected via the left earphone I/F 213 and right earphone I/F 214, respectively, the tension signals received by the left-side-tension signal I/F 212 and the right-side-tension signal I/F 215, and the acceleration signals received by the left-ear-placement detection signal I/F 211 and the right-ear-placement detection signal I/F 216. Then, the CPU 202 controls the audio data output through the left earphone I/F 213 and the right earphone I/F 214, the transmission of commands from the wireless communication module 204 to the remote terminal 150, and the power supply within the audio output apparatus 100.

The audio processor 205 processes the audio data received by the wireless communication module 204 in accordance with the control of the CPU 202. The processed audio data is output to the earphones 102, 103 through the left earphone I/F 213 and the right earphone I/F 214, respectively.

The remote terminal 150 has a hardware configuration similar to an ordinary computer, and has an wireless communication module, a CPU, and the like. Therefore, the explanations thereof are omitted.

Conventionally, when one of the earphones or both of the earphones is accidentally displaced while listening to audio data transmitted from a remote terminal, a user may miss listening to a portion of the audio data. Additionally, the user might desires to pause or decrease volume when the user intentionally removes the earphones to hear the surrounding sound. Therefore, the audio output apparatus 100 according to the embodiment detects whether at least one of the earphones is intentionally or accidentally displaced, and controls outputting of the audio data in accordance with the detection result. Consequently, the user can be prevented from missing the portion of the audio data, as well as operational difficulty causing loads on users can be suppressed.

Figure 3:
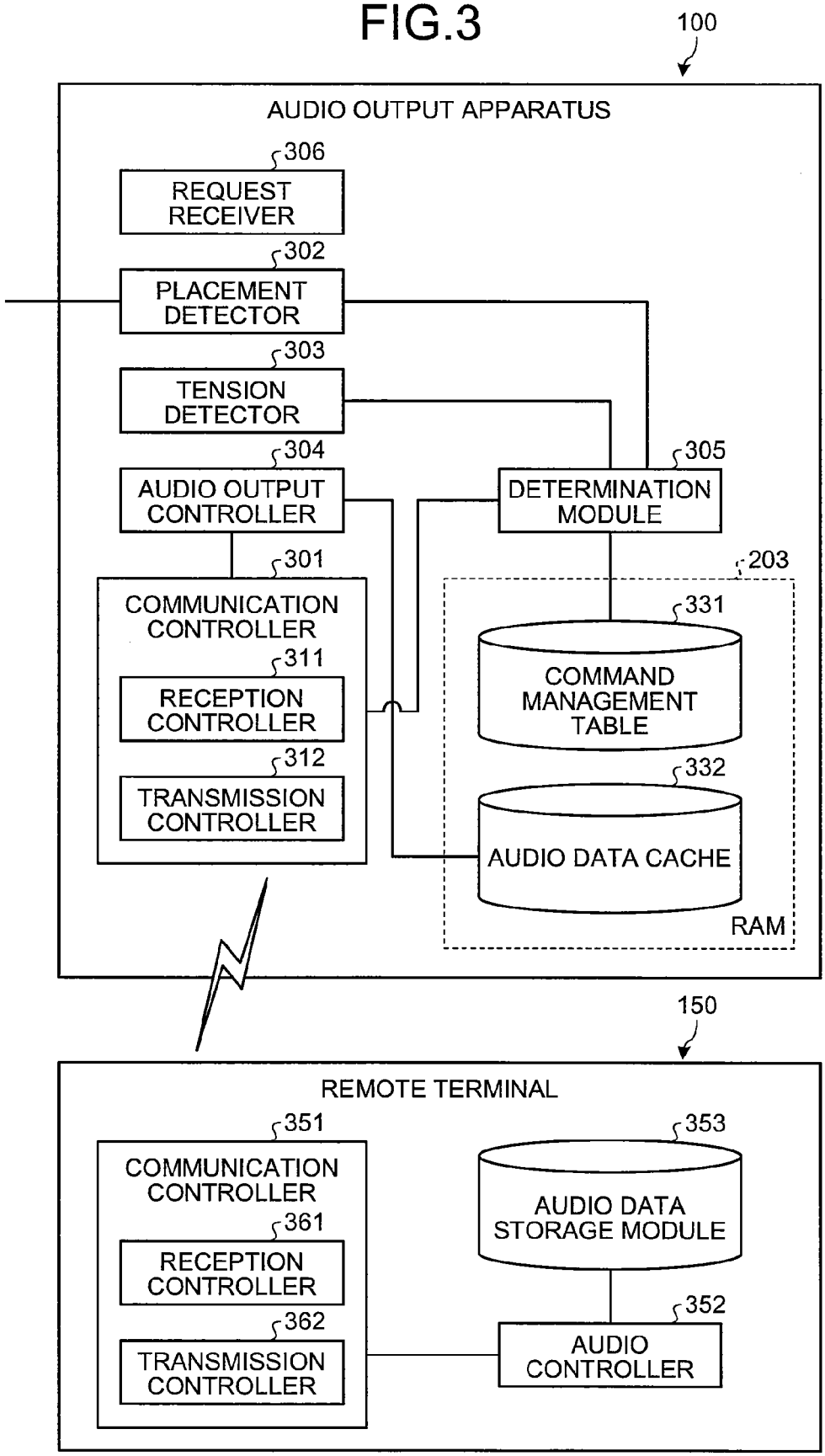
FIG. 3 is an exemplary block diagram of a software configuration of the audio output apparatus and the remote terminal in the embodiment.

A software configuration of the audio output apparatus 100 and the remote terminal 150 capable of performing the aforementioned control are explained. FIG. 3 is a block diagram illustrating a software configuration of the audio output apparatus 100 and the remote terminal 150.

As illustrated in FIG. 3, the remote terminal 150 has a communication controller 351, an audio controller 352, and an audio data storage module 353, and provides the audio data to the audio output apparatus 100.

The audio data storage module 353 stores therein audio data to be provided to the audio output apparatus 100 and the like. The audio data may have any format, such as advanced audio coding (AAC), moving picture experts group audio layer-3 (MP3), or windows media player (WMP).

The communication controller 351 has a reception controller 361 and a transmission controller 362. The communication controller 351 controls communication with respect to the audio output apparatus 100 by using the wireless communication (not illustrated) provided in the remote terminal 150. In the embodiment, the Bluetooth (Registered Trademark) is used for the wireless communication. The remote terminal 150 performs paring with respect to the audio output apparatus 100. The remote terminal 150 is capable of using various profiles such as A2DP and AVRCP.

The reception controller 361 controls receiving data from the audio output apparatus by using the wireless communication provided in the remote terminal 150. Further, the reception controller 361 can receive various control commands from the audio output apparatus 100 by utilizing the AVRCP. The control commands include, for example, play and stop commands, fast forward and rewind commands, a volume control command, and an audio synthesis command.

The audio synthesis command is for synthesizing stereo sounds and output the synthesized stereo sounds as a monaural sound so that the user can listen to the entire sound through one ear. Since particular process for the synthesis is based on the aforementioned profile, the explanations thereof are omitted.

The transmission controller 362 controls transmitting data with respect to the audio output apparatus 100. Further, the transmission controller 362 can control transmitting stereo sound and high quality audio data to the audio output apparatus 100 by utilizing the A2DP. Furthermore, the transmission controller 362 can control the transmission of the monaural sound and high quality audio data.

The audio controller 352 processes the audio data read out from the audio data storage module 353, and output it to the transmission controller 362. In particular, the audio controller 352 process the audio data in accordance with the control command input by the remote terminal 150 or the control command received by the reception controller 361. For example, the audio controller 352 synthesizes the stereo sounds to generate the monaural sound, controls the volume of the audio data, and/or the like, in accordance with the audio synthesis command. Next, the audio output apparatus 100 is explained.

As the software configuration, the audio output apparatus 100 has a placement detector 302, a tension detector 303, an audio output controller 304, a communication controller 301, a determination module 305, and a request receiver 306. The audio output processor 100 controls output of the audio data based on the placement of the earphones using a command management table 331, an audio data cache 332, and the like stored in the RAM 203. First, the command management table 331 and the audio data cache 332 stored in the RAM 203 are explained.

The command management table 331 is a table for managing commands for the remote terminal 150 and the like. FIG. 4 illustrates a table configuration of the command management table 331. As illustrated in FIG. 4, the command management table 331 stores therein items "PLACEMENT," "TENSION DETECTED," "CURRENT SITUATION," and "CONTENT TO BE EXECUTED," in association with each other.

In other words, process and commands under item "CONTENT TO BE EXECUTED" are transmitted when the conditions under items "PLACEMENT," "TENSION DETECTED," and "CURRENT SITUATION" are satisfied.

Under the item "PLACEMENT," conditions for the placement of the earphones are set. When one of the conditions under the item "PLACEMENT" meets the detection result of the placement detector 302 described later, the condition is said to be satisfied.

Under the item "TENSION DETECTED," flags indicating whether the cable connected to at least one of the earphones is pulled, or in other words, whether the tension of greater than or equal to the predetermined threshold value is detected, are set. The flag of "1" indicates that the tension of greater than or equal to the predetermined threshold value is detected, and the flag of "0" indicates that the tension of less than the threshold value is detected.

Under the item "CURRENT SITUATIONS," current situations required to perform the contents to be executed (in other words, results already detected by the placement detector 302 and the tension detector 303) are set. The indication of "–" indicates that the current situation can be anything.

Under the item "CONTENT TO BE EXECUTED," process to be executed by the audio output apparatus 100 and commands to be transmitted to the remote terminal 150 are set.

In FIG. 4, when the "PLACEMENT" indicates the condition "BOTH EARPHONES NOT IN PLACE" and the "TENSION DETECTED" indicates the flag of "0," it is assumed that the user intentionally removed both of the earphones 102, 103 because the cables 108, 109 have not been pulled. In this case, the "PAUSE COMMAND" is transmitted to the remote terminal 150.

When the "PLACEMENT" indicates the condition "BOTH EARPHONES NOT IN PLACE" and the "TENSION DETECTED" indicates the flag of "1," it is assumed that both of the earphones 102, 103 are accidentally displaced because the cables 108, 109 have been pulled.

When the "PLACEMENT" indicates the condition "ONE OF EARPHONES NOT IN PLACE" and the "TENSION DETECTED" indicates the flag of "0," it is assumed that the user is intentionally removed one of the earphones. In this case, the "AUDIO SYNTHESIS COMMAND" is transmitted to the remote terminal 150 so that the user can listen to the entire sounds through one ear. In addition, the "VOLUME DECREASE COMMAND" is transmitted to the remote terminal 150 so that the user can listen to the surrounding sound.

When the "PLACEMENT" indicates the condition "ONE OF EARPHONES NOT IN PLACE" and the "TENSION DETECTED" indicates the flag of "1," it is assumed that one of the earphones (the earphone 102 or the earphone 103) is accidentally displaced because one of the cables (the cable 108 or the cable 109) have been pulled. In this case, the "AUDIO SYNTHESIS COMMAND" is transmitted to the remote terminal 150 so that the user can listen to the entire sounds through one ear.

The command management table 331 stores therein commands to be executed when at least one of the earphones 102, 103 is back in place from the aforementioned situation (when the "PLACEMENT" indicates "AT LEAST ONE OF EARPHONES NOT IN PLACE AT LEAST ONE EARPHONES BACK IN PLACE") and the like. Accordingly, audio data suitable for the situation of when at least one of the earphones is back in place can be provided.

When both of the earphones are displaced accidentally, the audio data cache 332 stores therein the output audio data. When both of the earphones are accidentally displaced, the tension detector 303 described later detects the tension of greater than or equal to the threshold value, and the placement detector 302 detects that both of the earphones 102, 103 are not in place.

The placement detector 302 detects whether the two earphones 102, 103 are each placed in the user's ears. In the embodiment, the placement detector 302 detects the placement of the earphones 102, 103 based on the acceleration signals from the placement detection sensors 104, 106 built in the left earphone 102 and the right earphone 103, respectively.

In the embodiment, the placement detector 302 determines that the left earphone 102 is displaced from the user or determines that the left earphone 102 is not in place when the placement detector 302 determines that the acceleration signal received by the left-ear-placement detection signal I/F 211 is greater than the predetermined threshold value preliminarily set in the RAM 203. Further, the placement detector 302 determines that the right earphone 103 is displaced form the user or determines that the right earphone 103 not in place when the placement detector 302 determines that the acceleration signal received by the right-ear-placement detection signal I/F 216 is greater than the predetermined threshold value preliminarily set in the RAM 203.

Further, the placement detector 302 detects that at least one of the earphones that is displaced is back in place. Various techniques may be used to detect such situation. For example, orientation of the earphone (102, 103) determined from the acceleration signal can be used to detect that the displaced earphone is back in place in the user's ear.

The tension detector 303 detects whether the tension signals received from the left-side-tension signal I/F 212 and the right-side-tension signal I/F 215 are greater than or equal to the predetermined threshold value. When the tension of greater than or equal to the threshold value is detected, it is assumed that the earphone is accidentally displaced. On the other hand, when the tension of less than the threshold value is detected, it is assumed that the earphone is intentionally removed. The threshold value is set by actually measuring a reference point at which the earphone currently in place is accidentally displaced, and in the embodiment, an appropriate value based on the actual measurement is set. The threshold value is preliminarily stored in the RAM 203.

The determination module 305 determines the control command for the audio data and the process to be executed transmitted to the remote terminal 150, based on a combination of the detection result of the placement detector 302 and the detection result of the tension detector 303. During the determination, the determination module 305 also takes into account whether one of the earphones or the both of the earphones are not in place, which is the detection result of the placement detector 302. Further, during the determination, the determination module 305 of the embodiment refers to the command management table 331.

For example, when the tension detector 303 detects the tension that is greater than or equal to the predetermined threshold value and the placement detector 302 detects that both of the earphones 102, 103 are not in place, the determination module 305 refers to the command management table 331. Then, the determination module 305 determines and selects the pause command as a command to be transmitted, as well as determines and selects the process for recording audio data of few seconds to the audio data cache 332.

Then, when the placement detector 302 detects that the earphones 102, 103 are back in place, the determination module 305 selects the output process of the audio data recorded in the audio data cache 332 and the play command for continuation of the audio reproduction.

The control command to be selected and the process to be executed when the tension of greater than or equal to the predetermined threshold value is not detected and it is detected that the both earphones 102, 103 are not in place, the control command to be selected and the process to be executed when the tension of greater than or equal to the predetermined threshold value is detected and it is detected that one of the earphones 102, 103 is not in place, and the control command to be selected and the process to be executed when the tension of greater than or equal to the predetermined threshold value is not detected and it is detected that one of the earphones 102, 103 is not in place, can be derived from FIG. 4. Therefore, explanations thereof are omitted.

In the embodiment, the process to be executed and the control commands to be transmitted are determined by taking into account the combination of whether the earphones are in place and whether the tension of greater than or equal to the threshold value is detected. However, in the embodiment, the process is not limited thereto, and the control commands and the like to be transmitted to the remote terminal 150 may be determined based only on whether the tension is greater than or equal to the threshold value. In other words, it is possible to determine the control commands and the like as such because the detection of the tension can determine whether the earphone is displaced. Consequently, control of the audio data based on the placement of the earphone can be executed. Therefore, user convenience is enhanced.

The communication controller 301 has a reception controller 311 and a transmission controller 312, and controls communication with respect to the paired remote terminal 150 using various profiles of the Bluetooth (Registered Trademark).

The reception controller 311 controls and receives various data including the audio data from the remote terminal 150 via the wireless communication module 204.

The transmission controller 312 controls and transmits various data including the control commands of the audio data with respect to the remote terminal 150 via the wireless communication module 204. The control commands to be transmitted are determined by the determination module 305.

After the reception controller 311 receives the audio data and the audio processors processes the audio data, the audio output controller 304 controls and outputs the audio data to at least one of the earphones 102, 103. During the output control, when the input audio data corresponds to stereo data, appropriate audio data is assigned to the left earphone 102 and the right earphone 103. On the other hand, when the input audio data corresponds to monaural data, the audio data is distributed to one of the left earphone 102 and the right earphone 103 that is still in place. On the other hand, when the audio data is the monaural data, the same audio data can be output to both of the left earphone 102 and the right earphone 103.

The audio output controller 304 processes the audio data based on the process determined by the determination module 305. For example, when the determination module 305 determines and selects the recording of the audio data of few seconds to the audio data cache 332, the audio output controller 304 records the output audio data to the audio data cache 332. Further, when the output of the audio data recorded in the audio data cache 332 is selected, the audio output controller 309 reads out the audio data from the audio data cache 332, and output the audio data to each of the earphones 102, 103. The audio output controller 304 output the audio data processed by the audio processor 205 to each of the earphones 102, 103. Consequently, when the earphones are displaced, the user can be able to continuously listen to the audio data from a few seconds before the earphones are displaced.

In response to the user's operation, the request receiver 306 receives contents to be registered under the item "CONTENT TO BE EXECUTED" of the command management table 331. The contents that can be set as the item "CONTENT TO BE EXECUTED" may be displayed on a display (not illustrated) of the remote terminal 150. FIG. 5 illustrates an exemplary screen for receiving a particular content to be executed when at least one of the earphones 102, 103 is displaced. As illustrated in FIG. 5, a desired process is set from the pull-down menu for a particular combination of a number of displaced earphones and intentionality of the displacement (whether the tension of greater than or equal to the threshold value is detected).

Then, when the user selects the content to be executed, the request receiver 306 sets the content under the item "CONTENT TO BE EXECUTED" in the command management table 331. Consequently, a user desired process is performed when at least one of the earphones 102, 103 is displaced.

Figure 6:
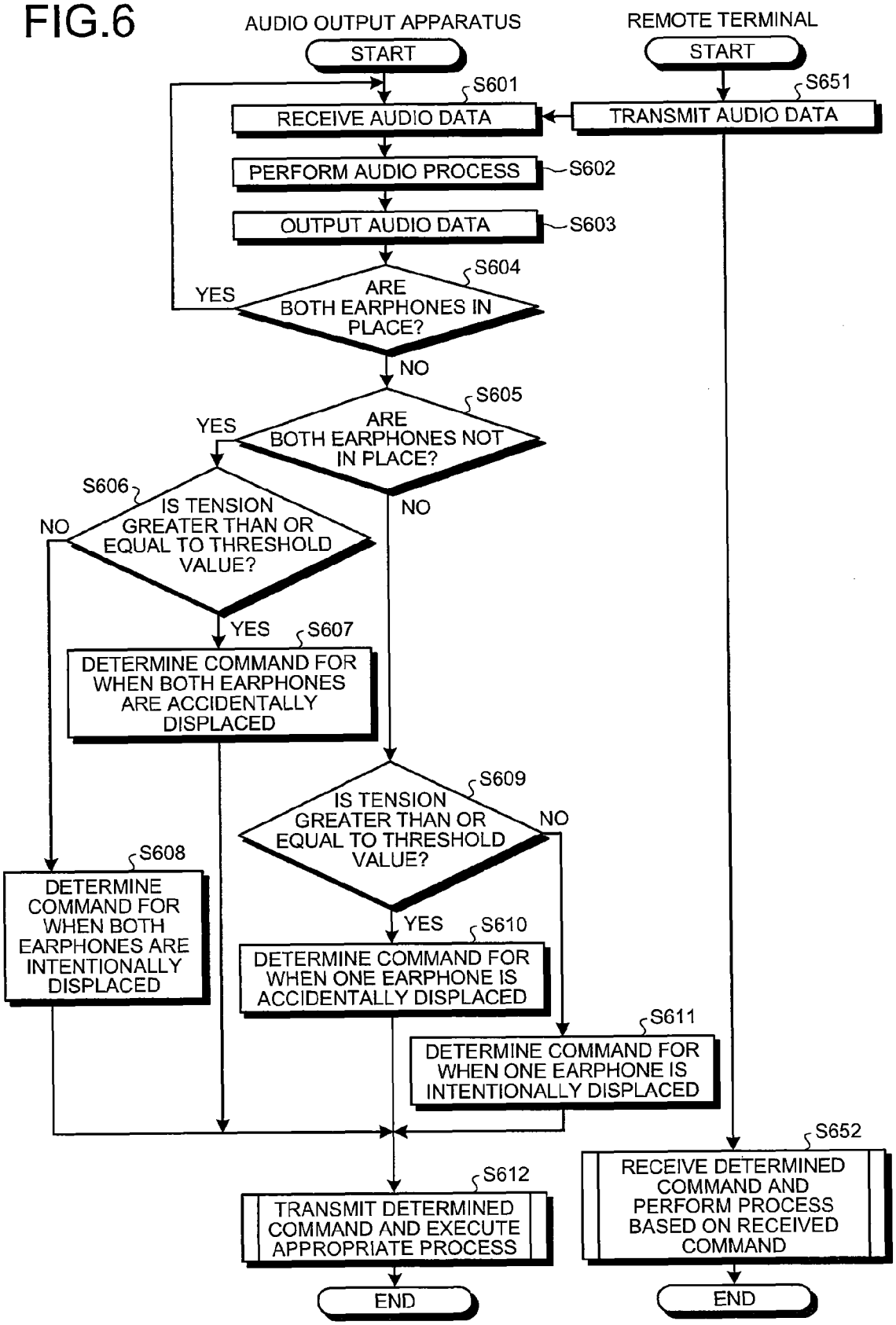
FIG. 6 is an exemplary flowchart of the audio output apparatus and the remote terminal of when at least one of the earphones of the audio output apparatus is displaced in the embodiment.

Next, the overall process of the audio output apparatus 100 and the remote terminal 150 of when at least one of the earphones 102, 103 is displaced is explained. FIG. 6 is a flowchart illustrating the aforementioned process in the audio output apparatus 100 and the remote terminal 150. In the following, it is assumed that the user is already playing the audio data at the time when the process of FIG. 6 begins.

First, in the remote terminal 150, the transmission controller 362 transmits the audio data by using the Bluetooth (Registered Trademark) (S651).

In response, the audio output apparatus 100 receives the audio data through the wireless communication module 204 (S601). Then, the audio processor 205 performs process on the received audio data (S602).

The audio output controller 304 outputs the processed audio data through the left earphone I/F 213 and the right earphone I/F 214 (S603).

The placement detector 302 detects whether both the earphones 102, 103 are in place in both of the user's ears. When it is detected that the both of the earphones 102, 103 are in place (Yes at S604), the receiving and outputting of the audio data are continuously performed (S601 to S603). Consequently, the audio data can be heard as usual while it is confirmed that the both earphones 102, 103 are in place.

On the other hand, when the placement detector 302 detects that at least one of the earphones 102, 103 is not in place (No at S604), the placement detector 302 determines whether both of the earphones 102, 103 are not in place (S605). As a result, when it is detected that the both of the earphones 102, 103 are not in place (Yes at S605), the tension detector 303 detects whether the tension signals received through the left-side-tension signal I/F 212 and the right-side-tension signal I/F 215 are each greater than or equal to the predetermined threshold value (S606). Here, both of the two tension signals received through the left-side-tension signal I/F 212 and the right-side-tension signal I/F 215 respectively are required to be determined to be greater than or equal to the predetermined threshold value.

As a result, when it is detected that the tensions are greater than or equal the threshold value (Yes at S606), the determination module 305 refers to the command management table 331. Then, the determination module 305 selects the pause command as the control command to be executed when the both earphones 102, 103 are accidentally displaced, and also selects the recording of the audio data as the process to be executed (S607). Then, the process of FIG. 6 proceeds to S612.

When the tension of greater than or equal to the threshold value is not detected while both earphones are not in place (No at S606), the determination module 305 refers to the command management table 331. Then, the determination module 305 selects the pause command as the control command to be executed when the both earphones 102, 103 are intentionally removed. Then, the process is followed by S612 in FIG. 6.

In S605, when the placement detector 302 detects that only one earphone is not in place (No at S605), the tension detector 303 detects whether the tension signal received through the left-side-tension signal I/F 212 or the right-side-tension signal I/F 215 is greater than or equal to the predetermined threshold value (S609). In S609, it is determined whether one of the received tension signals is greater than or equal to the predetermined threshold value.

As a result, when it is detected that the tension of greater than or equal to the threshold value is detected (Yes at S609), the determination module 305 refers to the command management table 331. Then, the determination module 305 selects the audio synthesis command as the control command that is to be executed when one of the earphones 102, 103 is accidentally displaced (S610). Then, the process is followed by S612 in FIG. 6.

On the other hand, when the tension of greater than or equal to the threshold value is not detected while one of the earphones is not in place (No at S609), the determination module refers to the command management table 331. Then, the determination module 305 selects the pause command and the volume decrease command as the control command to be executed when one of the earphones 102, 103 is intentionally removed (S611). Then, the process in FIG. 6 proceeds to S612.

Next, the audio output apparatus 100 transmit the selected control command, and performs later described process corresponding to the situation (S612).

Then, the remote terminal 150 receives the control command, and performs later described process based on the control command (S652).

By the aforementioned process, the control command corresponding to the placement of the earphones is executed. Next, the process based on the selected control command is explained for each situation.

Figure 7:
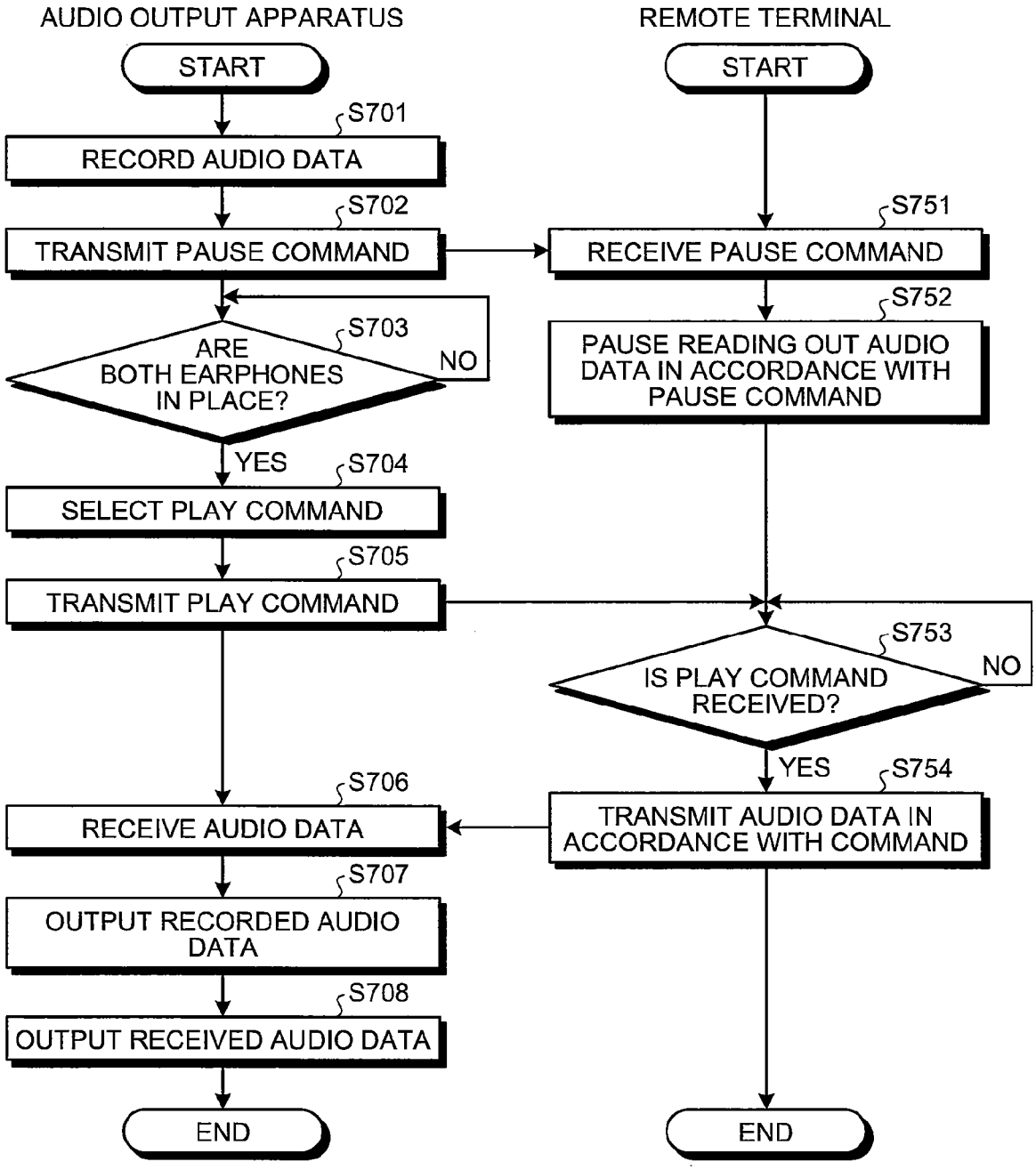
FIG. 7 is an exemplary flowchart of process performed after a determination module selects, when both of the earphones are accidentally displaced, a pause command and recording of audio data in the embodiment.

FIG. 7 is a flowchart illustrating the process of S612 and S652 of when the both earphones 102, 103 are accidentally displaced (corresponding to S607) so that the determination module 305 selects the recording of the audio data and the pause command. In the embodiment, it is assumed that the user quickly places back the earphones 102, 103 when the both earphones 102, 103 are displaced.

The audio output controller 304 records the audio data of a few seconds, which is already output to the earphones, to the audio data cache 332 (S701). Any techniques can be used for the recording, and for example, the audio data of a few seconds may be cached constantly to the RAM 203.

Next, the transmission controller 312 transmits the pause command selected by the determination module 305 to the remote terminal 150 through the wireless communication module 204 (S702).

Then, the reception controller 361 of the remote terminal 150 receives the pause command (S751).

Next, the audio controller 352 of the remote terminal 150 stops the process between the reading of the audio data from the audio data storage module 353 and the transmission of the audio data, in accordance with the received pause command (S752).

In the audio output apparatus 100, the placement detector 302 detects whether the both earphones 102, 103 are back in place (S703). When it is detected that the both earphones 102, 103 are not back in place, S703 is repeated until the both earphones 102, 103 are back in place (S703).

When the placement detector 302 detects that the both earphones 102, 103 are back in place (Yes at S703), the determination module refers to the command management table 331. Then, the determination module determines the play command as the content to be executed based on the detection result of the placement detector 302 and the current situation (S704).

Then, the transmission controller 312 transmits the determined play command to the remote terminal 150 (S705).

In the remote terminal 150, the reception controller 361 determines whether the play command is received (S753). When it is determined that the play command is not received (No at S753), S753 is repeated until the play command is received.

When the reception controller 361 determines that the play command is received (Yes at S753), the audio controller 352 starts reading out the audio data from the audio data storage module 353 in accordance with the play command, and the transmission controller 362 starts the transmission of the read out audio data (S754).

Accordingly, the reception controller 311 of the audio output apparatus 100 receives the audio data from the remote terminal 150 (S706). Then, the audio output controller 304 outputs the audio data stored in the audio data cache 332 (S707), and outputs the continuously received audio data that is processed by the audio processor 205 (S708).

By the aforementioned process, the reproduction of the audio data of the period between when the both earphones 102, 103 are accidentally displaced and when the both earphones 102, 103 are replaced can be stopped, and the audio data can be reproduced again after the both earphones 102, 103 are back in place. In the embodiment, the pause command is selected as the control command of when the both earphones 102, 103 are accidentally displaced. However, the embodiment is not limited thereto, and commands other than the pause command such as a stop command, a record command, a volume adjust command, or a combination thereof may be used.

FIG. 8 is a flowchart illustrating the process of S612 and S652 of FIG. 6 of when the both earphones 102, 103 are intentionally removed (corresponding to S608 of FIG. 6) so that the determination module 305 selects the pause command. In the following, it is assumed that the user desires to pause the audio data when the both earphones 102, 103 are intentionally removed.

The transmission controller 312 transmits the pause command selected by the determination module 305 to the remote terminal 150 through the wireless communication module 204 (S801).

Then, the reception controller 361 of the remote terminal 150 receives the pause command (S851).

Next, the audio controller 352 of the remote terminal 150 stops the process between when the audio data is read out from the audio data storage module 353 and when the audio data is transmitted, in accordance with the received pause command (S852).

In the audio output apparatus 100, the placement detector 302 detects whether the both earphones 102, 103 are in place (S802).

When the placement detector 302 detects that the both earphones 102, 103 are in place (Yes at S802), the determination module 305 refers to the command management table 331. Then, the determination module 305 selects the "PLAY COMMAND" as the content to be executed, based on the detection result of the placement detector 302 and the current situation (S803).

Then, the transmission controller 312 transmits the selected play command to the remote terminal 150 (S804).

In the remote terminal 150, the reception controller 361 determines whether the play command is received (S853).

When the reception controller 361 determines that the play command is received (Yes at S853), the audio controller 352 starts reading out the audio data from the audio data storage module 353, and the transmission controller 362 starts transmitting the read out audio data, in accordance with the play command (S854).

Accordingly, the reception controller 311 of the audio output apparatus 100 receives the audio data from the remote terminal 150 (S805). Then, the audio output controller 304 outputs the received audio data processed by the audio processor 205 (S806), and the process is finished.

When the placement detector 302 does not detect that the both earphones 102, 103 are in place (No at S802), the determination module 305 determines whether the condition of "AT LEAST ONE OF EARPHONES NOT IN PLACE OR PREDETERMINED TIME" set under the "PLACEMENT" of the command management table 331 is met (S807). When it is determined that the predetermined time is not elapsed (No at S807), the process from S802 is repeated.

When the determination module 305 determines that the condition of "AT LEAST ONE OF EARPHONES NOT IN PLACE OR PREDETERMINED TIME" is met (Yes at S807), the determination module 305 selects the "POWER OFF COMMAND" that is associated with the "AT LEAST ONE OF EARPHONES NOT IN PLACE OR PREDETERMINED TIME" in the command management table 331, as the content to be executed (S808). Then, the transmission controller 312 transmits the selected "POWER OFF COMMAND" (S809), and finishes the process.

In the remote terminal 150, when it is determined that the play command is not received (No at S853), the reception controller 361 determines whether the power off command is received (S855). When it is determined that the power off command is not received (No at S855), the process is repeated from S853 again.

When it is determined that the power off command is received (Yes at S855), the reception controller 361 turns off the main power of the remote terminal 150 in accordance with the received power off command (S856).

By the aforementioned process, user suitable process is performed when the both earphones 102, 103 are intentionally removed. In the embodiment, the pause command is selected as the control command selected when the both earphones 102, 103 are intentionally removed. However, the embodiment is not limited thereto, and commands other than the pause command, such as a stop command, a record command, a volume adjust command, or a combination thereof, maybe selected.

Further, in the embodiment, the reproduction of the audio data is paused when the both earphones 102, 103 are intentionally removed, and the audio data is reproduced again from the point where the audio data has been paused. However, the embodiment is not limited thereto, and for example, the audio data can be reproduced from the beginning. Furthermore, for example, when the remote terminal 150 is playing the received audio data in real time, the audio data can be recorded instead of the pausing, and the recorded data can be played automatically when the both earphones 102, 103 are back in place.

Figure 9:
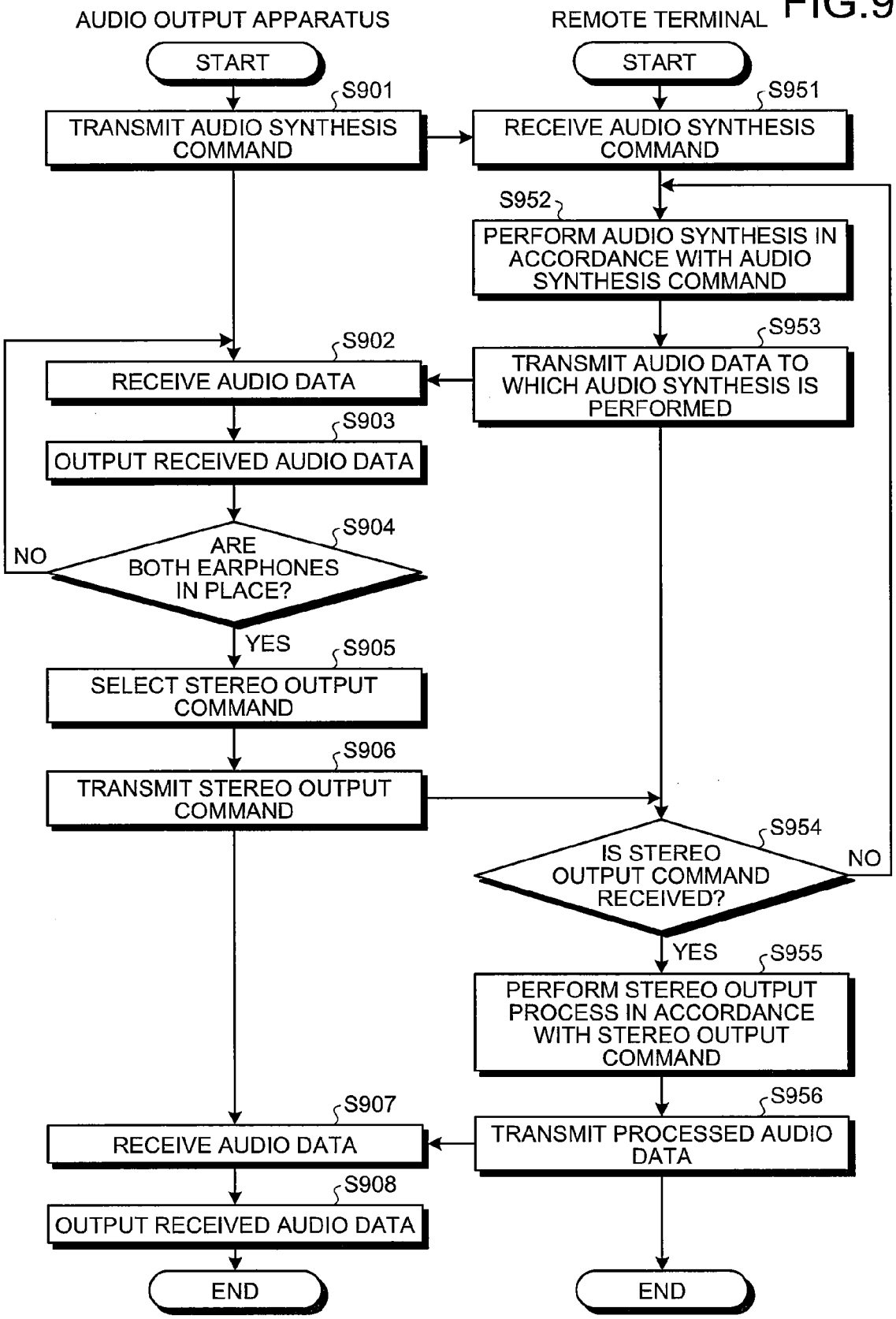
FIG. 9 is an exemplary flowchart of process performed after the determination module selects, when one of the earphones is accidentally displaced, an audio synthesis command in the embodiment.

FIG. 9 is a flowchart of the process of S612 and S652 of FIG. 6 when one of the earphones 102, 103 is displaced (corresponding to S610 of FIG. 6) so that the determination module 305 selects the audio synthesis command. In the embodiment, it is assumed that the user quickly places back the earphone when one of the earphones 102, 103 is accidentally displaced. Hence, in the embodiment, the audio data for both of the ears is output to one of the earphones 102, 103 that is still in place. Consequently, the entire audio data can be heard until the displaced earphone is back in place.

The transmission controller 312 transmits the audio synthesis command selected by the determination module 305 to the remote terminal 150 through the wireless communication module 204 (S951).

Then, the reception controller 361 of the remote terminal 150 receives the audio synthesis command (S951).

Next, the audio controller 352 of the remote terminal 150 synthesizes the audio data in accordance with the received audio synthesis command, so that the entire stereo audio data read out from the audio data storage module 353 can be heard in monaural (S952). Here, any conventional audio synthesis techniques can be used, so that the explanations thereof are omitted.

The transmission controller 362 of the remote terminal 150 starts transmitting the synthesized audio data (S953).

Accordingly, the reception controller 311 of the audio output apparatus 100 receives the synthesized audio data (S902). Then, the audio output controller 304 outputs the received audio data processed by the audio processor 205 to the one of the earphones 102, 103 that is still in place (S903). On the other hand, the synthesized audio data can be output to both of the earphones 102, 103 as long as the entire audio data can be heard through the earphone that is still in place.

Then, the placement detector 302 detects whether the other one of the earphones 102, 103 that is not in place is back in place in the user's ear (S904). When the other one of the earphones 102, 103 is still not in place (No at S904), the process between the receiving of the synthesized audio data and the outputting of the audio data are repeated (S902 to S903).

When the placement detector 302 detects that the other one of the earphones 102, 103 is back in place (Yes at S904), the determination module 305 refers to the command management table 331. Then, the determination module 305 selects the stereo output command as the control command to be transmitted (S905). The transmission controller 312 transmits the selected stereo output command to the remote terminal 150 (S906).

In remote terminal 150, the reception controller 311 determines whether the stereo output command is received (S954). When it is determined that the stereo output command is not received (No at S954), the process from S952 is repeated.

When the reception controller 311 determines that the stereo output command is received (Yes at S954), the audio controller performs process for outputting the audio data in stereo (S955). Then, the transmission controller 362 transmits the stereo audio data (S956), and completes the process.

The audio output apparatus 100 receives the audio data from the remote terminal 150 (S907). Then, the audio output controller 304 outputs the received audio data processed by the audio processor 205 to each of the earphones 102, 103 in stereo (S908).

By the aforementioned process, the user can be prevented from being unable to listen to the audio data when the one of the earphones 102, 103 is accidentally displaced. In the embodiment, the audio synthesis command is selected as the command to be selected when the one of the earphones 102, 103 is accidentally displaced. However, the embodiment is not limited thereto, and commands other than the audio synthesis command, such as a volume adjust command, a pause command, a record command, or any combination thereof, may be selected.

Figure 10:
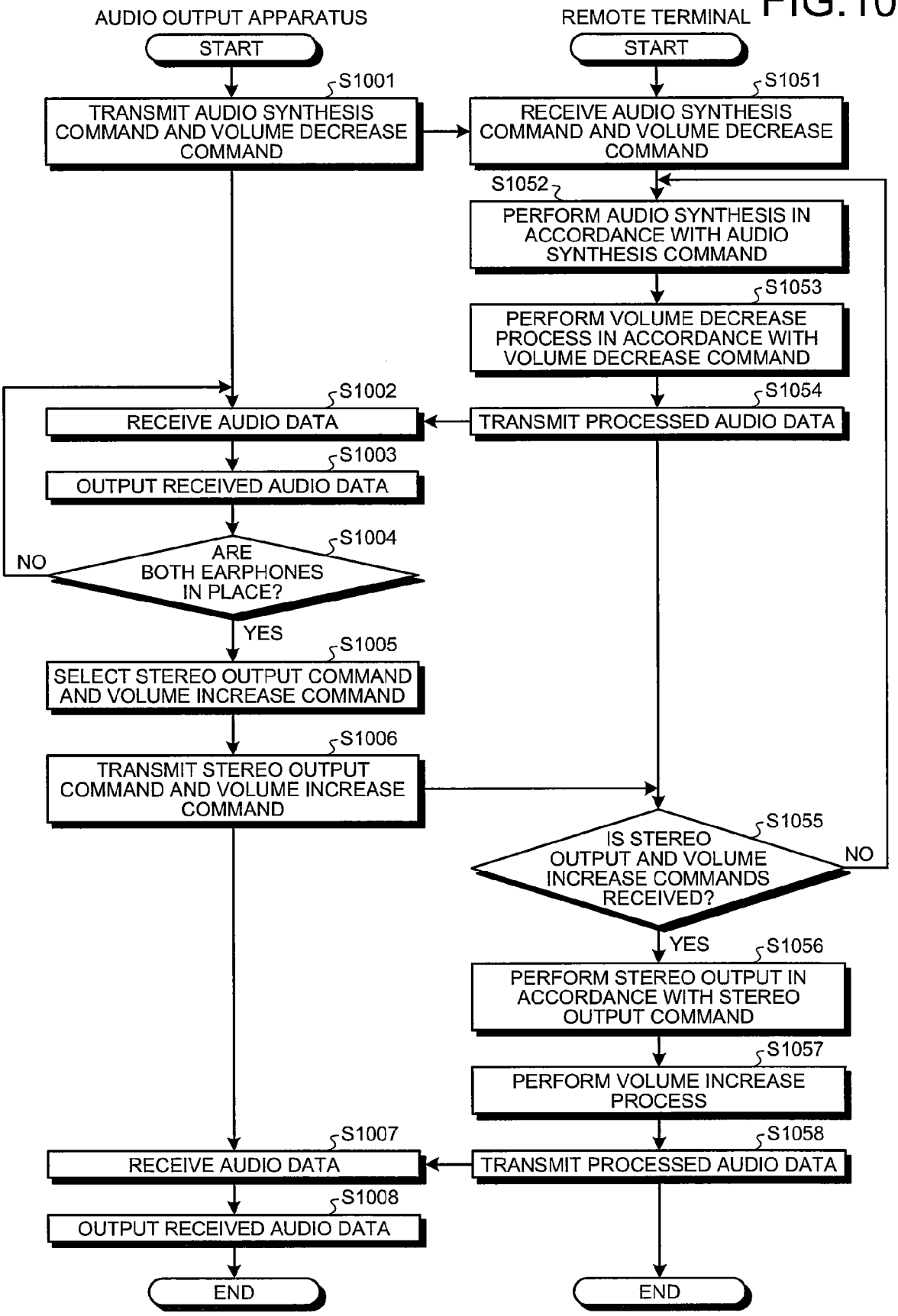
FIG. 10 is an exemplary flowchart of process performed after the determination module selects, when one of the earphones is intentionally removed, the audio synthesis command and the volume decrease command in the embodiment.

FIG. 10 is a flowchart illustrating the process of S612 and S652 of FIG. 6 of when one of the earphones 102, 103 is intentionally removed (corresponding to S611 of FIG. 6) so that the determination module 305 selects the audio synthesis command and the volume decrease command. In the embodiment, it is assumed that the user desires to listen to the surrounding sound when the one of the earphones 102, 103 is intentionally removed. Therefore, in the embodiment, the audio data for both ears is output to other one of the earphones 102, 103 that is still in place, as long as the volume is decreased so that the surrounding sound can be heard.

The transmission controller 312 transmits the audio synthesis command and the volume decrease command selected by the determination module 305 to the remote terminal 150 through the wireless communication module 204 (S1001).

Then, the reception controller 361 of the remote terminal 150 receives the audio synthesis command and the volume decrease command (S1051).

The audio controller 352 of the remote terminal 150 synthesizes the audio data in accordance with the received audio synthesis command so that the stereo audio data read out from the audio data storage module 353 can all be heard in monaural (S1052).

Then, the audio controller 352 of the remote terminal 150 decrease the volume of the audio data in accordance with the received volume decrease command (S1053) For the volume decrease process, the volume may be set to a predetermined value, or may be decreased for a certain amount with respect to the current volume.

The transmission controller 362 of the remote terminal 150 starts transmitting the audio synthesized and volume decreased audio data (S1054).

Accordingly, the reception controller 311 of the audio output apparatus 100 receives the audio synthesized and volume decreased audio data (S1002). Then, the audio output controller 304 outputs the received audio data processed by the audio processor 205 to the other one of the earphones 102, 103 that is still in place (S1003). By outputting the audio synthesized audio data to the other one of the earphones 102, 103 that is still in place, the user can be listen to the entire sounds even when only one earphone is in place. Further, since the volume is decreased, the user can easily hear the surrounding sound.

The placement detector 302 detects whether the other one of the earphones 102, 103 that is not in place is back in place in the user's ear (S1004). When the other one of the earphones 102, 103 is still not in place (No at S1004), the process from when the synthesized audio data is received until when the audio data is output is repeated (S1002 to S1003).

When the placement detector 302 detects that the other one of the earphones 102, 103 that is not in place is back in place (Yes at S1004), the determination module 305 refers to the command management table 331. Then, the determination module 305 selects the stereo output command and the volume increase command as the control command to be transmitted (S1005).

The transmission controller 312 transmits the selected stereo output command and the volume increase command to the remote terminal 150 (S1006).

In the remote terminal 150, the reception controller 311 determines whether the stereo output command and the volume decrease command are received (S1055). When it is determined that those control commands are not received (No at S1055), the process form S1052 is repeated.

When the reception controller 311 determines that the stereo output command and the volume increase command are received (Yes at S1055), the audio controller 352 performs process for outputting the audio data in stereo in accordance with the stereo output command (S1056).

Then, the audio controller 352 of the remote terminal 150 increases the volume of the audio data in accordance with the received volume increase command (S1057). For example, the volume is brought back to the volume before the decreasing, as the aforementioned volume decrease process.

The transmission controller 362 transmits the stereo audio data with the increased volume (S1058), and completes the process.

The audio output apparatus 100 receives the audio data from the remote terminal 150 (S1007). Then, the audio output controller 304 outputs the received audio data processed by the audio processor 205 to each of the earphones 102, 103 in stereo (S1008).

By the aforementioned process, the user can be prevented from being unable to listen to the audio data as well as the user can easily hear the surrounding sounds, when one earphone is intentionally removed. In the embodiment, the audio synthesis command and the volume decrease command are selected as the control commands selected for the case when the one of the earphones 102, 103 is intentionally removed. However, the embodiment is not limited thereto, and other commands such as a stop command, a pause command, a record command, or any combination thereof, can be selected.

In the aforementioned process, the audio synthesis and the volume adjustment are performed when one of the earphones is removed. However, other process such as pausing may be performed. In this case, when the one of the earphones is removed and the audio data is paused, the audio left paused can be played or the audio from the head can be played.

In the embodiment, the tension sensor is used to detect whether at least one of the earphones is intentionally removed. However, the embodiment is not limited thereto, and other sensors may be used as long as they can detect loads on the connecting portion between the cable and the earphone.

Conventionally, a sensor that detects whether the earphone is in place is used. However, such sensor cannot take into account the situations under which the earphones are displaced. Furthermore, the conventional process controls the audio information independently of the aforementioned situations. On the other hand, the audio output apparatus 100 according to the embodiment includes a sensor that can detect the loads on the connecting portion between the cable and the earphones, so that it is possible to detect whether at least one of the earphones is displaced intentionally or accidentally. Consequently, it is possible to suitably control the audio data.

Further, the audio output apparatus 100 according to the embodiment has the aforementioned configuration so as to be able to detect whether both earphones are displaced or one of the earphones is displaced, as well as to detect whether the at least one of the earphones is displaced intentionally or accidentally, while the user is listening to the audio data. Consequently, in combination of the aforementioned detection results, the audio data can suitably be controlled.

In the embodiment, it is explained the case when the audio data preliminarily stored in the remote terminal 150 is reproduced. However, the embodiment is not limited thereto, and the audio data to be reproduced may be audio data that has been received by the remote terminal 150 in real time. In this case, when the both of the earphones are displaced, the audio data can be recorded in RAM and the like, instead of pausing the audio data.

As described above, even when the user is listening to the audio data in real time, the situation under which the earphones are placed can be determined and the audio data can be recorded, so as to prevent the user from being unable to listen to the audio data. Furthermore, it is not limited to recording the audio data. In particular, when the one of the earphones is displaced, the audio data for both ears can be output to other one of the earphones that is still in place, the audio data can be paused, or the volume thereof can be decreased.

In the aforementioned embodiment and the modification, it is explained the case when the commands to be executed is determined from the signals sent from the sensors by the audio output apparatus. However, the aforementioned embodiment and the modification are not limited thereto, and the commands can be determined on the remote terminal side.

In this case, for example, the remote terminal 150 can have the aforementioned configuration of the audio output apparatus, and the audio output apparatus can transmit signals from the various sensors to the remote terminal. Accordingly, the remote terminal determines the commands and the like to be executed based on the received various signals, so as to control the audio data based on the determined command. As described above, whether the process should be performed by the audio output apparatus or the remote terminal can be determined by considering process load on each apparatuses.

An audio control program executed by the audio output apparatus 100 or the remote terminal 150 of the aforementioned embodiment and the modifications is stored in and provided by an computer readable recording medium such as a compact disk read only memory (CD-ROM), a flexible disk (FD), a compact disk recordable (CD-R), a digital versatile disk (DVD), and the like, as a file with installable format or executable format.

The audio control program can be stored in a computer connected to a network such as the Internet, and the audio control program can be downloaded through the network and provided. Further, the audio control program can be provided or distributed through the network such as the Internet.

The audio control program can be preliminarily stored in the ROM and the like and provided.

The audio control program executed by the audio output apparatus 100 of the embodiment has a module configuration including the aforementioned each modules (the request receiver, the placement detector, the tension detector, the audio output controller, the communication controller, the determination module). As an actual hardware, the CPU 202 reads out the audio control program from the storage medium and executes the audio control program to load the aforementioned each modules onto the main memory, thereby the request receive, the placement detector, the tension detector, the audio output controller, the communication controller, and the determination module are generated on the main memory.

The various modules of the systems described herein can be implemented as software applications, hardware and/or software modules, or components on one or more computers, such as servers. While the various modules are illustrated separately, they may share some or all of the same underlying logic or code.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An audio output apparatus, comprising:

a receiver configured to receive audio information from an audio processor;

a plurality of output modules configured to output the audio information;

a cable configured to connect between the output module and the receiver to communicate the audio information;

a tension detector configured to detect a tension applied to the cable;

a placement detector configured to detect whether the output module is in place with respect to a user; and a transmitter configured to transmit a first control command to the audio processor when the placement detector detects that the output modules are not in place and the tension detector detects a tension of greater than or equal to a predetermined threshold value, and configured to a second control command different from the first control command to the audio processor when the placement detector detects that the output modules are not in place and the tension detector does not detect the tension of greater than or equal to the threshold value.

2. The audio output apparatus of claim 1, wherein the placement detector is configured to detect whether each of the output modules is in place with respect to the user, and the transmitter is configured to transmit a different control command based further on a number of output modules not in place with respect to the user.

3. The audio output apparatus of claim 1, further comprising a storage module configured to store, when the placement detector detects that the output modules are not in place and the tension detector detects a tension of greater than or equal to a predetermined threshold value, the audio information output from the output module, wherein each of the output modules outputs, when the placement detector detects that the output modules are in place with respect to the user, the audio data stored in the storage module, the transmitter transmits, when the tension detector detects a tension of greater than or equal to the threshold value and the placement detector detects that the output modules are not in place with respect to the user, a control command for pausing transmission of the audio information, and transmits, when the placement detector detects that the output modules are in place with respect to the user, a control command for restarting transmission of the audio information.

4. The audio output apparatus of claim 1, further comprising a request receiver configured to receive the control command to be executed by the audio processor for each combination of whether a tension of greater than or equal to the threshold value is detected and a number of output modules not in place with respect to the user, wherein the transmitter is configured to transmit the control command set based on the control command received by the request receiver.

5. An audio processing system, comprising:

an audio output apparatus configured to output audio information; and an audio processor configured to provide the audio information to the audio output apparatus, wherein the audio output apparatus comprises:

a first receiver configured to receive audio information from the audio processor;

a plurality of output modules configured to output the audio information;

a cable configured to connect between the output module and the receiver to communicate the audio information;

a tension detector configured to detect a tension applied to the cable;

a placement detector configured to detect whether the output module is in place with respect to a user; and a first transmitter configured to transmit a first control command to the audio processor when the placement detector detects that the output modules are not in place and the tension detector detects a tension of greater than or equal to a predetermined threshold value, and configured to a second control command different from the first control command to the audio processor when the placement detector detects that the output modules are not in place and the tension detector does not detect the tension of greater than or equal to the threshold value, and the audio processor comprises:

a second transmitter configured to transmit the audio information to the audio output apparatus;

a second receiver configured to receive the control command from the audio output apparatus; and a controller configured to control the audio information in accordance with the control command received by the second receiver.

6. The audio processing system of claim 5, wherein the placement detector is configured to detect whether each of the output modules is in place with respect to the user, and the transmitter is configured to transmit a different control command based further on a number of output modules not in place with respect to the user.

* * * * *